US007114625B2

(12) United States Patent
Jones et al.

(10) Patent No.: US 7,114,625 B2
(45) Date of Patent: Oct. 3, 2006

(54) TWIST CAP

(75) Inventors: Robert Jones, Minlaton (AU); Andrew Mark Crick, Hope Valley (AU)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 10/240,450

(22) PCT Filed: Apr. 5, 2001

(86) PCT No.: PCT/AU01/00385

§ 371 (c)(1),
(2), (4) Date: Apr. 7, 2003

(87) PCT Pub. No.: WO01/76964

PCT Pub. Date: Oct. 18, 2001

(65) Prior Publication Data

US 2003/0155361 A1 Aug. 21, 2003

(30) Foreign Application Priority Data

Apr. 5, 2000 (AU) ..... PQ6698

(51) Int. Cl.
*B65D 41/17* (2006.01)
*B65D 41/04* (2006.01)
*B65D 41/18* (2006.01)

(52) U.S. Cl. ..... 215/318; 215/305; 215/320

(58) Field of Classification Search ..... 215/317, 215/318, 321, 341, 343, 344, 305, 320; 220/304, 220/288, 793; 383/61.1, 33
See application file for complete search history.

(56) References Cited

U.S. PATENT DOCUMENTS 3,292,807 A * 12/1966 Golde ..... 215/305
3,300,073 A * 1/1967 Benz ..... 215/253
4,103,798 A * 8/1978 Moeller ..... 215/305
4,412,409 A 11/1983 Aichinger et al.
5,036,991 A * 8/1991 Wallman ..... 215/256
5,190,178 A * 3/1993 Luch ..... 215/256
5,443,172 A * 8/1995 Gabriele ..... 215/303
5,762,218 A 6/1998 Sachau
5,865,331 A * 2/1999 Jacobs ..... 215/228
6,059,134 A * 5/2000 Long, Jr. ..... 215/252
6,102,227 A * 8/2000 Cochrane ..... 215/256
6,176,394 B1 * 1/2001 Shimko et al. ..... 222/92
6,394,295 B1 * 5/2002 Claude ..... 215/318

FOREIGN PATENT DOCUMENTS

GB 2 311 285 A 9/1997
JP 40-8790 7/1988
JP 11301713 A 2/1999
WO WO 93/07070 A1 4/1993
WO WO 94/20380 A1 9/1994

* cited by examiner

*Primary Examiner*—Nathan J. Newhouse
*Assistant Examiner*—Niki M. Eloshway
(74) *Attorney, Agent, or Firm*—Watson IP Group, PLC; Jovan N. Jovanovic; Vladan M. Vasiljevic

(57) ABSTRACT

A cap for sealing a container having a threaded spout. The cap is arranged so that it can be snapped onto and off the spout and so that it can also be screwed on and off the spout.

14 Claims, 2 Drawing Sheets

TWIST CAP

TECHNICAL FIELD

The present invention relates to a cap for sealing a container having a threaded spout. The container may be a plastic bag, pouch, bladder, bag-in-box container or a rigid container, etc.

BACKGROUND ART

In the catering and fast food industries many different food products are purchased in plastic bags, pouches, bladders and bag-in-box containers. Examples of such typical food products include tomato products, citrus products, soft drink syrups, fruit purees, fruit sauces and flavouring. These types of containers are advantageous over other packaging containers because they can be used in ambient, hot fill and aseptic process applications. Additionally, such containers are light weight, easy to transport and cost efficient process.

Typically these plastic bags, pouches, bladders and bag-in-box containers are made from a combination of polymer materials which may, in some instances, be coated with or contain gas barrier materials. The bags or pouches are generally fitted with a plastic pouring spout which is rigidly attached to the bag. The spout is sealed by a cap. The cap is arranged to be secured to the spout in a manner whereby it can be "snapped off" mechanically prior to filling the bag with product and then reapplied or "snapped on" by applying a downward force onto the cap and the axially aligned spout. The cap has a centrally located plug which seals the spout and a skirt extending from the top of the cap. The skirt is provided to prevent foreign matter from entering the exterior of the spout. It is standard practice for the plug to engage in the aperture of the spout in a manner whereby an hermetic seal is formed.

As stated above, during the filling operation the cap is removed mechanically. Removal typically is achieved using a mechanical jaw to uncap the cap. However, when the product is used by the end user, the cap must be removed manually. Given the nature of the connection between the plug and the spout and the configuration thereof, it is extremely difficult to remove the cap by hand. Considerable force is required to lever the cap off the spout. As these types of bags are used in many of the fast food chains, typically, the person trying to remove the cap is a youth who may not be strong enough to remove the cap. In order to overcome this problem uncapping tools are sometimes used. However, it is still quite difficult to remove the cap and often the uncapping tool can't be found when needed.

It is also quite common for users to slash the bag to empty the product, rather than remove the cap and pour the product through the spout. Although this is not a problem when the entire contents of the bag are to be used, in some situations it is desirable to only use a small proportion of the contents and to store the remainder in the bag in a refrigerator. This is particularly a concern to caterers who have a limited turnover. In other situations, it is necessary to pour the contents into a dispenser and thus is not particularly desirable to slash the bag.

The present invention seeks in one aspect to provide an improved cap which can be easily removed by hand from the spout of the bag or container while still enabling the cap to be removed and replaced mechanically on a filling machine.

SUMMARY OF INVENTION

The present invention relates to a cap for sealing a container having a spout, said cap being arranged so that it can be snapped onto the spout and can be uncapped or snapped off, and said cap also being arranged to be screwed onto and screwed off the spout.

In a first aspect of the invention, there is provided a cap for sealing a container having a spout, said cap having a threaded portion arranged to engage with a correspondingly shaped threaded portion of the spout, said cap also having a plug means arranged to sealingly engage within the spout and wherein the threaded portion of the cap can be moved over the threaded portion of the spout so that the cap can be snapped onto and off the spout.

Preferably, the action of snapping the cap onto and off the spout may be performed manually, without the use of a tool.

Preferably, either the threaded portion of the cap or an adjacent portion thereto is flexible so as to enable the threaded portion of the cap to move over the correspondingly shaped threaded portion of the spout when the cap is snapped onto and off the spout. Flexible movement of the threaded portion of the cap or the adjacent portion thereto is preferably in a direction away from the longitudinal axis of the spout. Typically, the threaded portion is flexible in a radially outwardly direction.

It is envisaged that the threaded portion of the spout may also be flexible to better enable the cap to move over the threaded portion of the spout when the cap is snapped onto and off the spout.

The threaded portion of the cap is preferably located on an inner face of a skirt which depends from the top of the cap. The skirt preferably has a flexible zone which enables the threaded portion to be moveable thereby enabling the cap to snap onto and off the spout.

The flexible zone of the skirt typically includes the entire skirt. However, it will be apparent to those skilled in the art that the flexible zone may include a specific point or points on the skirt or may be defined by a portion extending circumferentially about the skirt.

The cap further includes a jaw engaging surface which is arranged to be engaged by the mechanical jaws of a filling machine. The mechanical jaws being arranged to "snap off" the cap from the spout.

The cap preferably also includes a gripping portion which extends about the periphery of the cap so as to enable the cap to be easily gripped by hand when screwing the cap onto and off the spout.

The invention also provides a spout including a flange arranged to enable connection to a container, a spout through which a product may be poured, and said spout having a threaded portion arranged to engage with a cap.

The spout preferably includes securing means by which the spout can be held when the cap is "snapped off" therefrom.

The present invention also relates to a combination including a bag having a threaded spout and a cap in accordance with the first aspect of the invention.

Additionally, the invention relates to a container having a threaded spout and a cap in accordance with the first aspect of the invention.

BRIEF DESCRIPTION OF DRAWINGS

An embodiment of the invention will now be described, by way of example only, with reference to the accompanying drawings in which.

DETAILED DESCRIPTION OF THE PREFERRED EMBODIMENT

Figure 1:
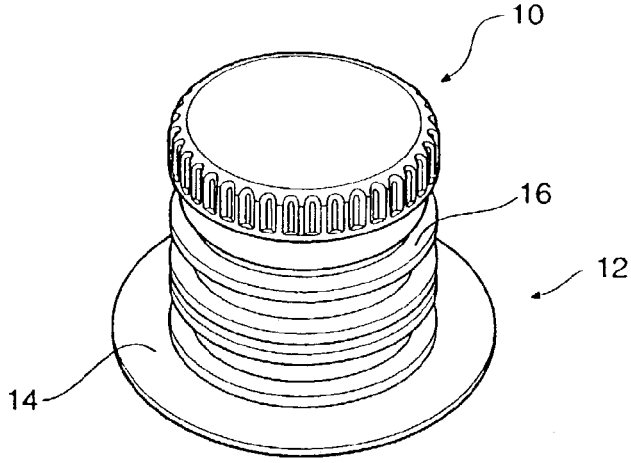
FIG. 1 is a perspective view of a cap in accordance with an embodiment of the invention secured to a spout.

FIG. 1 illustrates a cap 10 secured to a spout 12. In FIG. 1, the spout 12 is not secured to a plastic bag or other container. However, it will be apparent to those skilled in the art that when the spout 12 is secured to a bag or other container the lower flange 14 of the spout 12 will not be visible and will in fact be inside the bag or container. The body of the spout 16 would then extend through an aperture formed in the bag or container.

Figure 2:
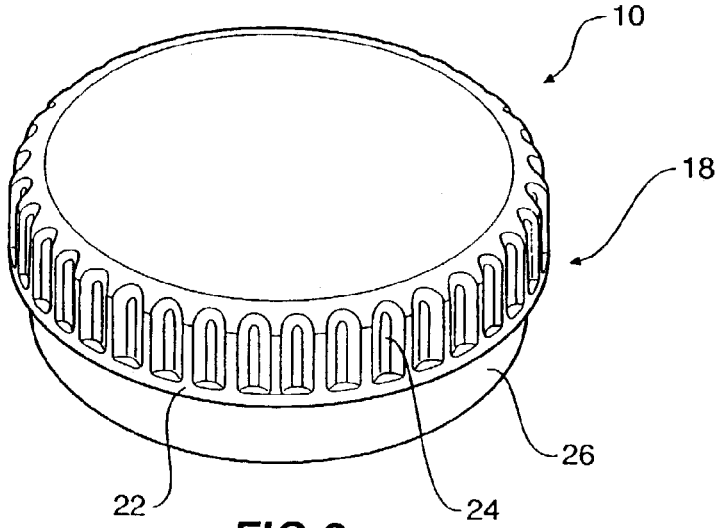
FIG. 2 is an enlarged perspective view of the cap shown in FIG. 1.
Figure 3:
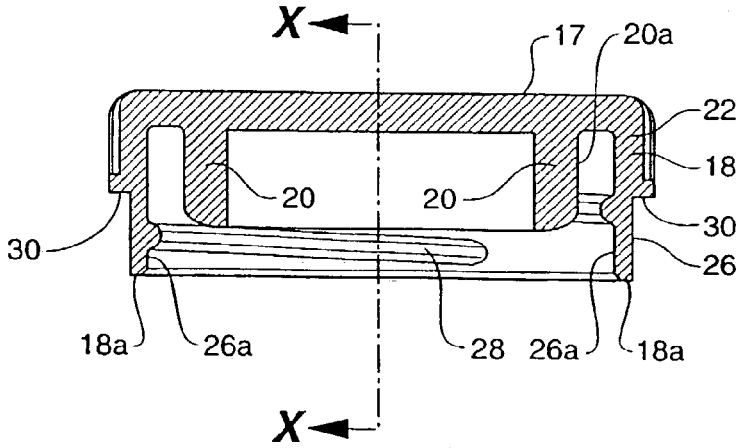
FIG. 3 is a cross-sectional view of the cap shown in FIG. 2.
Figure 4:
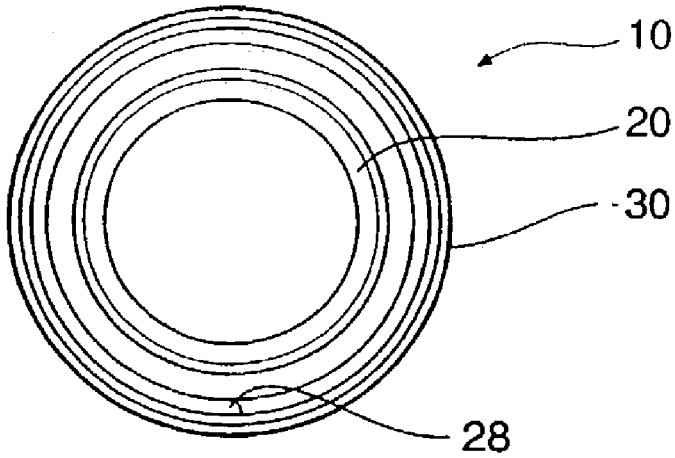
FIG. 4 is an underneath view of the cap shown in FIG. 2.
Figure 5:
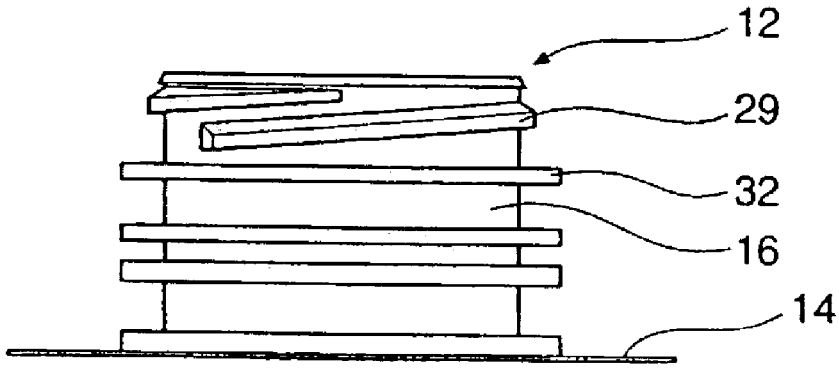
FIG. 5 is a side view of the spout shown in FIG. 1.

The cap 10 is best illustrated in FIGS. 2 and 3. The cap 10 includes a top 17, a downwardly depending skirt 18 and a plug 20. Plug 20 extends downwardly from the top 17 of the cap 10 and is located centrally of the axis x—x of the cap 10 (see FIG. 3). The plug 20 of the cap 10 is arranged to engage within the bore of the spout 12 so that there is a strong seal between the outer peripheral wall 20*a* of the plug 20 and the internal surface of the bore of the spout 12. The seal must be such that it prevents fluid from leaking out of the bag, as well as preventing micro-organisms from entering the bag. Ideally, the seal between the outer peripheral wall 20*a* and the internal surface of the bore of the spout 16 is an hermetic seal.

Skirt 18 includes an upper portion 22 which extends about the periphery of the top 17 of the cap 10. The upper portion 22 forms a gripping portion for manually screwing and unscrewing the cap 10 onto the spout 12. The gripping portion 22 is typically defined by a series of indentations 24.

The skirt 18 has a lower portion 26 distal from the upper portion 22. Located on the inner face 26*a* of the lower portion 26 of the skirt 18 is a screw thread 28.

Thread 28 is arranged to engage with a correspondingly shaped screw thread 29 on the body 16 of the spout 12.

Lower portion 26 of the skirt 18 has a wall thickness less than the wall thickness of the upper portion 22. In this manner, the lower portion 26 of the skirt 18 is flexible when compared to the upper portion 26 of the skirt 18.

Located between the upper portion 22 and the lower portion 26 of the skirt 18 is a jaw engaging surface 30. The purpose of the jaw engaging surface 30 will become apparent subsequently.

For hygiene reasons, the cap 10 is already in position on the spout 12 prior to filling of the bag. Accordingly, before a product can be introduced into the bag the cap 10 must be removed. Typically, the cap 10 is removed just prior to filling while the bag is mounted in the transport mechanism of a filling machine. Cap 10 is removed by mechanical jaws which engage about the outer periphery of the skirt 18 and against the jaw engaging surface 30. The jaw must engage with the skirt 18 in a manner whereby the skirt 18 can still flex outwardly away from axis x—x when the cap is being "snapped off" or "snapped on" the spout. Meanwhile, the spout 12 is engaged in the transport mechanism so that the spout 12 and attached bag are in position ready for filling.

To remove the cap 10, the jaws engage against the jaw engaging surface 30 and then move axially upwardly away from the spout 12. In this manner the cap 10 is "snapped off" the spout 12. To reapply the cap 10 onto the spout 12 after filling, a downward force is applied to the axially aligned cap 10 and spout 12.

In order for the cap 10 to be "snapped off" and "snapped on" the spout 12, a mechanism for enabling the thread 28 of the cap 10 to be passed over the thread 29 of the spout 12 must be provided. In the described embodiment, this mechanism is provided by a flexible portion which is defined by the lower portion 26 of the skirt 18. As mentioned previously, the lower portion 26 of the skirt is made flexible when compared to the upper portion 22 thereof because it has a reduced wall thickness. The flexible lower portion 26 of the skirt 18 enables the cap 10 to be "snapped on" and "off" the spout 12 because the lower portion 26 of the skirt 18 flexes outwardly away from the spout 12 when the thread 28 of the cap 10 contacts the thread 29 of the spout 12. This flexible movement of the skirt 18 enables the thread 28 of the cap 10 to be moved over the thread 29 on the body of the spout 12. The resilient nature of the skirt 18 enables it to return to its original orientation once thread 28 has moved over thread 29 of the spout 12.

When the cap 10 is "snapped" onto the spout 12, the lowermost edge 18*a* of the skirt 18 rests on the upper flange of the spout 12. In this manner, the skirt 18 and flange 32 provide a barrier to prevent contamination from entering into the inside of the cap 10 or the outside of the spout 12.

As stated above, the cap 10 can be "snapped on" or "snapped off" the spout 12. However, because of the thread 28 on the cap 10 and the thread 29 on the spout 12, it is also possible to remove the cap 10 by simply unscrewing it from the spout 12. This means that the cap 10 can be unscrewed to allow easy and quick access to the bag's contents. Thus, it becomes quite simple to empty some of the contents from the bag before reapplying the screw cap 10 to reseal the remaining contents within the bag. The remaining contents can then be stored in the bag in a refrigerator. Another advantage of this arrangement is that filling of dispensing machines and other forms of machinery becomes easier because the contents of the bag can simply be poured out through the spout after unscrewing the cap 10. Other dispensing devices with a matching thread may also be directly applied to the spout.

Use of the cap and spout arrangement described herein also negates the need to have any form of uncapping tool.

A cap in accordance with an embodiment of the invention is much easier to use than prior art arrangements because it can be screwed on and off the spout 12. The size of the top 17 of the cap 10 and the gripping portions 22 facilitate the easy gripping and opening of the cap 10. Thus, it will be appreciated that the threaded spout 12 and the cap 10 in combination make uncapping, pouring and recapping of the product much easier for the end user. Additionally, it will be appreciated that the ease of opening and resealing of the cap reduces waste of product and is therefore more cost efficient.

It will be appreciated by those skilled in the art that to function properly the cap 10 in accordance with an embodiment of the invention must have a mechanism by which the thread 28 of the cap 10 can be moved over the thread on the spout 12 when it is being "snapped on" and "snapped off". Although, the present invention describes the use of a flexible skirt it is envisaged that other methods for ensuring appropriate movement of the thread 28 could be adopted. It is envisaged that the skirt may include in one arrangement a specific point or points of flexibility located between the engaging surface 30 and the thread 28. Alternatively, a ring of decreased thickness in this location could be used.

The cap and spout in accordance with the embodiment of the invention are preferably made of a plastics material. This enables the cap and spout to be manufactured by injection molding.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed in Australia before the priority date of each claim of this application.

We claim:

1. A cap for sealing a container having a spout, said cap including a top wall and a downwardly depending skirt, said skirt including an upper portion extending downwardly from the top wall and a lower portion downwardly extending from the upper portion, a threaded portion having threads, wherein the threads are located within the lower portion and is arranged to engage with a correspondingly shaped threaded portion of the spout, said cap also including a plug means extending from a lower surface of the top wall arranged in use to sealingly engage within the spout of the container and wherein the threaded portion of the cap can be moved over the threaded portion of the spout so that the cap can be snapped onto and off the spout, said cap further including an engaging surface against which pressure can be applied separating the threaded portion of the cap from said spout, so as to snap said cap off said spout, said engaging surface extending substantially perpendicularly from said skirt and being located in its entirety between the top and the threads of the threaded portion.

2. A cap according to claim 1 wherein the action of snapping the cap onto and off the spout may be performed manually, without the use of a tool.

3. A cap according to claim 1 wherein either the threaded portion of the cap or an adjacent portion thereto is flexible so as to enable the threaded portion of the cap to move over the correspondingly shaped threaded portion of the spout when the cap is snapped onto and off the spout.

4. A cap according to claim 3 wherein flexible movement of the threaded portion of the cap or the adjacent portion thereto is in a direction away from the longitudinal axis of the spout.

5. A cap according to claim 3 wherein the threaded portion of the spout is also flexible to enable the cap to move over the threaded portion of the spout when the cap is snapped onto and off the spout.

6. A cap according to claim 1 wherein the threaded portion of the cap is located on an inner face of the depending skirt.

7. A cap according to claim 6 wherein the skirt has a flexible zone which enables the threaded portion to be moveable thereby enabling the cap to snap onto and off the spout.

8. A cap according to claim 7 wherein the flexible zone of the skirt includes the entire skirt.

9. A cap according to claim 1 further including a gripping portion which extends about the periphery of the cap so as to enable the cap to be easily gripped by hand when screwing the cap onto and off the spout.

10. A cap according to claim 9 wherein the gripping portion extends between the top and the threaded portion, to, in turn, enable the cap to be easily gripped by hand when screwing the cap onto and off the spout.

11. A cap according to claim 10 wherein the gripping portion comprises a plurality of indentations.

12. A bag having a threaded spout and a cap according to claim 1.

13. A cap according to claim 1 wherein the upper portion of the downwardly depending skirt has a wall thickness that is greater than a wall thickness of the lower portion of the downwardly depending skirt, the engaging surface defined by the junction between the upper portion and the lower portion.

14. A cap for sealing a container having a spout, said cap including a top and a downwardly depending skirt, said skirt including an upper portion extending downwardly from the top and a lower portion downwardly extending from the upper portion, a threaded portion is located within the lower portion and is arranged to engage with a correspondingly shaped threaded portion of the spout, said cap also including a plug means arranged in use to sealingly engage within the spout of the container and wherein the threaded portion of the cap can be moved over the threaded portion of the spout so that the cap can be snapped onto and off the spout, the plug means comprising an outer peripheral wall depending downwardly from the top and inwardly spaced apart from the upper portion of the downwardly depending skirt, the outer peripheral wall engaging with an inner bore of the spout to form a strong seal, said cap further including an engaging surface against which pressure can be applied separating the threaded portion of the cap from said spout, so as to snap said cap off said spout, said engaging surface extending substantially perpendicularly from said skirt and being located between the top and the threaded portion.

* * * * *